US006145776A

United States Patent [19]

Kemppi

[11] Patent Number: 6,145,776

[45] Date of Patent: Nov. 14, 2000

[54] ARRANGEMENT IN CONNECTION WITH A SPOOLER

[75] Inventor: Kyösti Kemppi, Espoo, Finland

[73] Assignee: Nextrom Holding S.A., Switzerland

[21] Appl. No.: 09/319,029

[22] PCT Filed: Dec. 16, 1997

[86] PCT No.: PCT/FI97/00790

§ 371 Date: May 28, 1999

§ 102(e) Date: May 28, 1999

[87] PCT Pub. No.: WO98/27002

PCT Pub. Date: Jun. 25, 1998

[30] Foreign Application Priority Data

Dec. 17, 1996 [FI] Finland ..... 965079

[51] Int. Cl.[7] ..... B65H 63/04; B65H 54/71

[52] U.S. Cl. ..... 242/487.2; 242/417.2

[58] Field of Search ..... 242/487.2, 417.2, 242/487.7; 226/25, 118.5, 102

[56] References Cited

U.S. PATENT DOCUMENTS

| | | | |
|---|---|---|---|
| 1,047,844 | 12/1912 | Xcott | 242/417.2 X |
| 3,561,654 | 2/1971 | Greiner | 226/25 |
| 4,597,352 | 7/1986 | Norminton . | |
| 4,690,349 | 9/1987 | Yamaguchi et al. | 242/417.2 X |
| 5,139,206 | 8/1992 | Butler | 242/417.2 X |
| 5,413,264 | 5/1995 | Kotzur et al. . | |
| 5,865,393 | 2/1999 | Kreft et al. | 242/417.2 |

FOREIGN PATENT DOCUMENTS

| | | |
|---|---|---|
| 0374059 | 6/1990 | European Pat. Off. . |
| 3241362 | 5/1984 | Germany . |
| 3702702 | 9/1987 | Germany . |
| 4104087 | 8/1991 | Germany . |
| 4027275 | 3/1992 | Germany . |

*Primary Examiner*—Donald P. Walsh
*Assistant Examiner*—Collin A. Webb
*Attorney, Agent, or Firm*—Nixon & Vanderhye P.C.

[57] ABSTRACT

The invention relates to an arrangement in connection with a spooler, in which the cable to be spooled or the like is arranged to move onto the spooler or the like via accumulator, the moving wheels (2) of which are arranged to move between two extreme positions, depending on the line speed and the spooling speed, in such a manner that the moving wheels (2) are arranged to move into the lower extreme position (2*b*) when the line speed is higher than the spooling speed. To avoid damage a cutting means (6) is arranged in connection with the accumulator, the cutting means being arranged to touch the cable or the like moving via the moving wheels (2) when the moving wheels (2) of the accumulator move into the upper extreme position (2*a*) and to move into a position for cutting the cable or the like as a result of the motion of the cable or the like.

4 Claims, 3 Drawing Sheets

ARRANGEMENT IN CONNECTION WITH A SPOOLER

The invention relates to an arrangement in connection with a spooler, in which the cable to be spooled or the like is arranged to move onto the spooler or the like via an accumulator, the moving wheels of which are arranged to move between two extreme positions, depending on the line speed and the spooling speed, in such a manner that the moving wheels are arranged to move into the lower extreme position when the line speed is higher than the spooling speed and into the upper extreme position when the line speed is lower than the spooling speed. The term "cable" is intended herein to refer not only to a cable per se but to other elongated products as well.

When a cable or the like is spooled, such situations may occasionally arise in which the speed at which the cable or the like enters a spooler suddenly decreases due to some reason. Usually, the cable has stuck on the line, and thus the change in the speed is too abrupt for the spooler to adapt to it.

As a result of the situation described above either the cable is cut violently or the spooler or another line component is damaged due to too high a tension peak. In other words, such situations result in damage to the apparatus, e.g. to the guide wheels of the accumulator or, cable and may even cause severe physical injuries. The above situations are especially dangerous when thick cables are handled.

The above-mentioned dangerous situations which may result in damage have presented a problem, which is emphasized by the fact that no attempts have been made to provide existing spooling apparatus with a device which would help to eliminate the problem. An object of the invention is to provide an arrangement by means of which the problem related to the prior art can be obviated. This is achieved with the arrangement of the invention, which is characterized in that a cutting means is arranged in connection with the accumulator, the cutting means being arranged to touch the cable moving via the moving wheels when the moving wheels of the accumulator move into the upper extreme position and to move into a position for cutting the cable as a result of the motion of the cable.

The main advantage of the invention is that it allows to avoid possible damage to the spooler and other line components even when thick cables are spooled. Since damage can be avoided, probability of physical injuries also decreases substantially compared with the prior art. Further advantages of the invention are its simplicity and mechanical operation, and thus there is no need to control or synchronize the actuators electrically. Since the implementation of the invention is simple, the costs related to its introduction are relatively low.

In the following, the invention will be described in greater detail with reference to the accompanying drawings.

FIG. 1 shows a general side view an accumulator in connection with a spooler, FIG. 2 shows an accumulator according to FIG. 1 seen from another side, FIG. 3 shows on a larger scale the part of the accumulator according to FIG. 1 in which the arrangement of the invention is installed, and FIG. 4 shows the part according to FIG. 3 seen from another side.

DETAILED DESCRIPTION OF THE DRAWINGS

Figure 1:
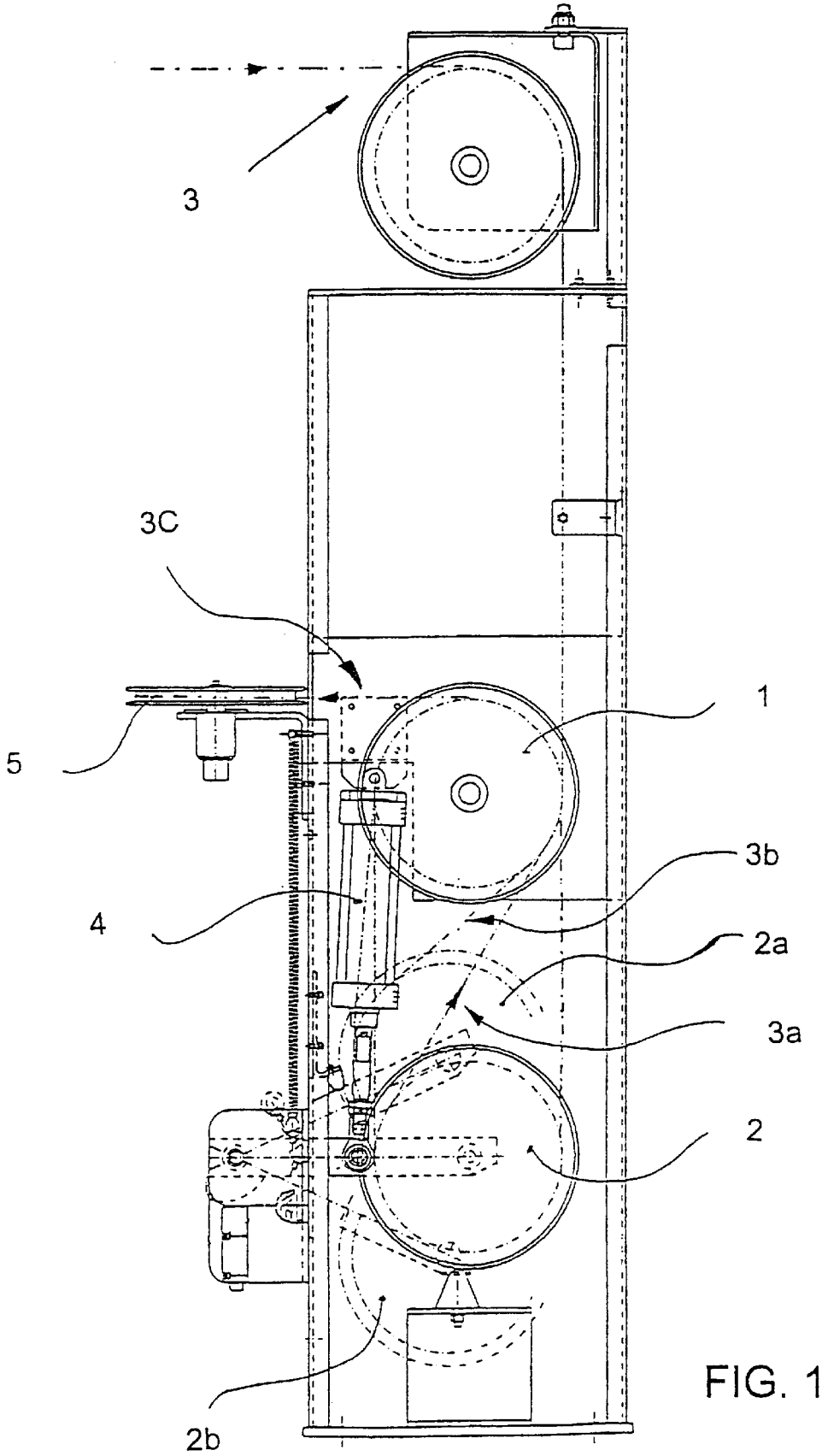
Figure 2:
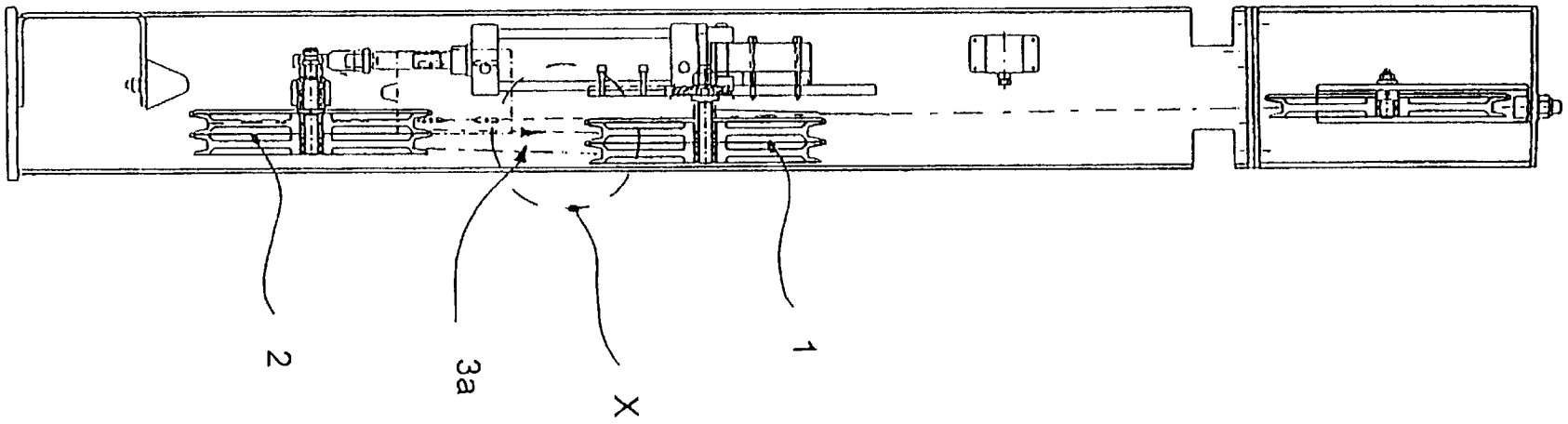

FIGS. 1 and 2 show an accumulator of the dancer type arranged, for example, in connection with a spooler. In FIG. 1 reference number 3 denotes the point where the cable enters the accumulator from the line. Reference number 3*a* denotes the path of the cable or other elongated product in the normal operating position of the accumulator when the moving wheels of the accumulator 2 are in the middle position. The fixed wheels of the accumulator are denoted by reference number 1.

The cable moves from the accumulator to the spooler via point 3*c* around a wheel 5 measuring the circumferential speed. The spooler is not illustrated in the figures. The structure and function of a spooler are fully conventional technology to one skilled in the art. A pneumatic cylinder 4 maintains a desirable level of tension in the cable.

During normal spooling, the moving wheels 2 of the accumulator may alternate between the upper position 2*a* and the lower position 2*b*. The lower position 2*b* of the moving wheels 2 means that the accumulator is completely open, i.e. the line speed at point 3 is higher than the spooling speed at point 3*c*. In this situation the spooler gives the line a command to stop and also stops itself simultaneously.

The upper position 2*a* of the moving wheels 2 means that the accumulator is shut, i.e. the spooling speed at point 3*c* is higher than the line speed at point 3. In this situation the current tension in the cable increases abruptly. In that case, the cable moves along the path indicated by reference number 3*b*. The extreme position of the path of the cable is an essential feature of the invention, as will be explained below. In FIG. 2, reference symbol X denotes the point where the arrangement of the invention is located in the accumulator. The point indicated by reference symbol X is illustrated in greater detail in FIGS. 3 and 4.

Figure 3:
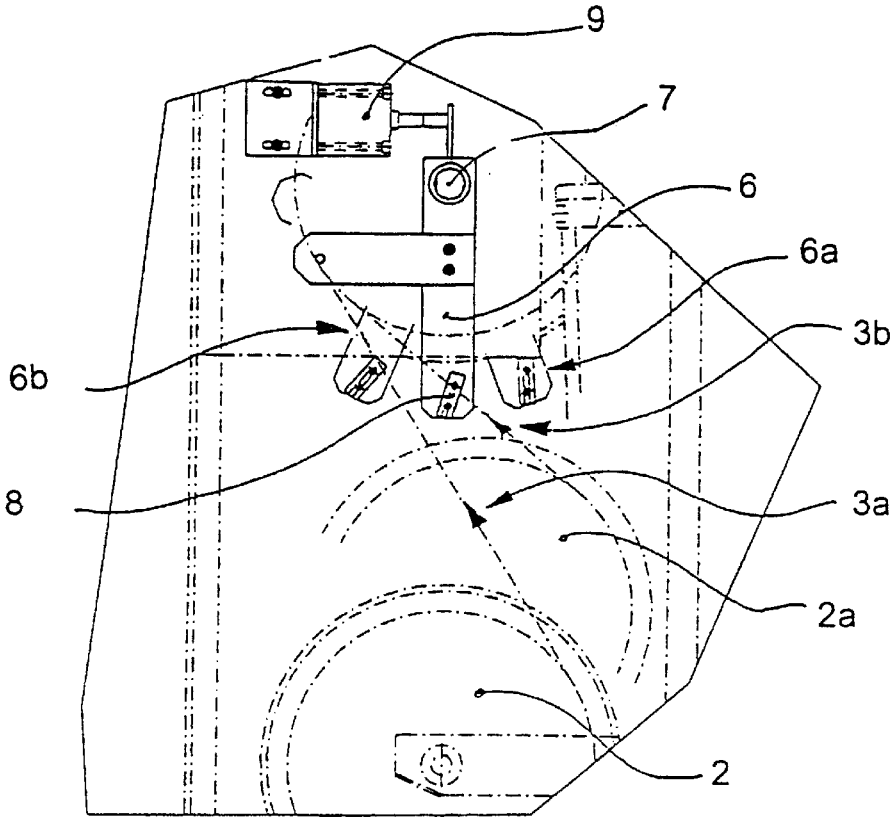

According to the basic idea of the invention, a cutting means 6 is arranged in connection with the accumulator, the cutting means being arranged to touch the cable moving via the moving wheels 2 when the moving wheels 2 of the accumulator move into the upper extreme position 2*a* and to move into a position for cutting the cable as a result of the motion of the cable. FIG. 3 illustrates the cutting means 6 in a spooling position. In the figure, the cutting means 6 is arranged turnably, i.e. it is pivoted on an axle 7 secured to the body of the accumulator. In FIG. 3, reference number 6*a* denotes the threading position of the cutting means, which can be maintained e.g. by spring force. The spring is not illustrated in the figures. In this position of the cutting means 6, the path of the cable is such that the cable does not touch the blade 8 of the cutting means 6. The normal position of the cutting means 6, i.e. the position illustrated as the middle position in FIG. 3, is provided e.g. by a pneumatic cylinder 9. The cutting means is in this position during spooling. When the accumulator is shut and the path of the cable is in accordance with reference number 3*b*, the blade 8 of the cutting means touches the cable, causing the cutting means 6 to revolve around the axle 7 into position 6*b*. As a result of the above-mentioned revolution the blade 8 cuts the cable, after which the cutting means 6 returns to position 6*a* e.g. with spring force.

As it can be noted on the basis of the above description, the arrangement of the invention functions completely mechanically. It should also be noted that the power for cutting the cable is provided by the motion of the cable, and therefore, no separate power source is needed for cutting.

Figure 4:
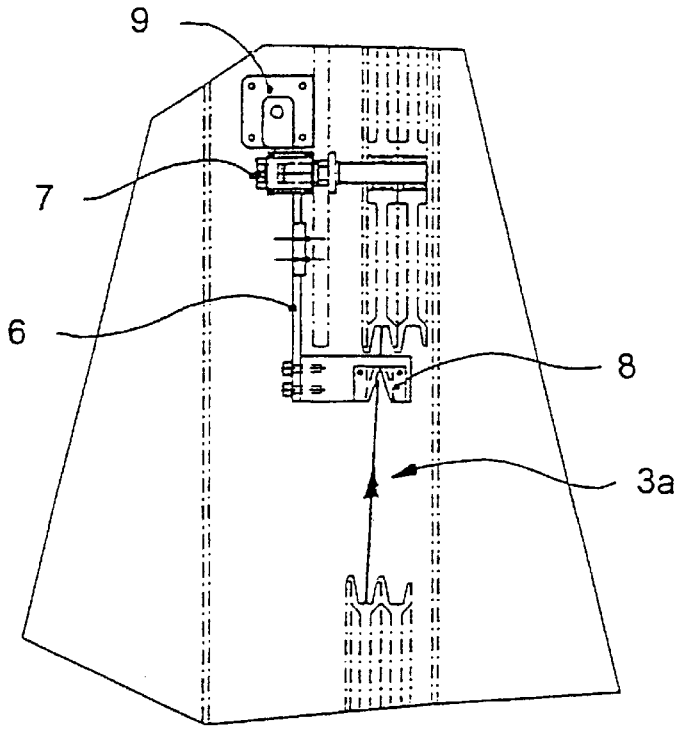

In the embodiment of the figures the blade 8 of the cutting means 6 is of the groove type. It has been discovered that a blade the groove of which is substantially V-shaped, as illustrated in FIG. 4, is especially preferable.

The embodiment described above is by no means intended to limit the invention, but the invention may be modified completely freely within the scope of the claims. It will be obvious that the arrangement of the invention or its details need not be precisely as described above, but solutions of other kinds are also possible. The cutting means, for example, does not need to be pivoted on the axle as in the embodiment of the figures, but it is also possible to use a blade which moves e.g. on appropriately arranged guide tracks, etc. The invention is neither limited to be used in connection with cables, but the invention can also be used for spooling other elongated products. Furthermore, the invention is by no means limited to spoolers of a certain type or to spoolers in general, but the invention can be applied to automatic double spoolers, single spoolers, pulling devices, etc.

What is claimed is:

1. Apparatus for winding a cable comprising a spooler on which the cable is to be wound and an accumulator adapted to move the cable onto the spooler, said accumulator having moving wheels arranged to move between upper and lower extreme positions, depending on line speed and spooling speed of the cable, in such a manner that the moving wheels are arranged to move into the lower extreme position when the line speed is higher than the spooling speed and into the upper extreme position when the line speed is lower than the spooling speed; and cutting means arranged to engage the cable when the moving wheels of the accumulator move into the upper extreme position and to move into a position for cutting the cable as a result of movement of the cable.

2. Apparatus as claimed in claim 1 wherein the cutting means is pivotably mounted on an axle secured to the body of the accumulators, and wherein the cutting means is arranged to revolve around the axle as a result of the movement of the cable and to cut the cable simultaneously.

3. Apparatus as claimed in claim 1 wherein the cutting means comprises a blade having a groove.

4. Apparatus as claimed in claim 3 wherein the groove is substantially V-shaped.

* * * * *